United States Patent [19]

Lee et al.

[11] Patent Number: 4,851,191

[45] Date of Patent: Jul. 25, 1989

[54] HIGH STRENGTH AND WEAR RESISTANCE COPPER ALLOYS

[75] Inventors: Kun S. Lee, Seoul; Dong K. Park, Incheon, both of Rep. of Korea

[73] Assignee: Poong San Metal Corporation, Incheon, Rep. of Korea

[21] Appl. No.: 179,774

[22] Filed: Apr. 11, 1988

[30] Foreign Application Priority Data

Apr. 10, 1987 [KR] Rep. of Korea ..... 87/3452

[51] Int. Cl.[4] ..... C22C 9/01; C22C 9/05

[52] U.S. Cl. ..... 420/471; 148/433

[58] Field of Search ..... 420/469, 471; 148/433

[56] References Cited

FOREIGN PATENT DOCUMENTS

| | | | |
|---|---|---|---|
| 53-100913 | 9/1978 | Japan . | |
| 0163231 | 12/1981 | Japan | 420/471 |
| 59-116347 | 7/1984 | Japan . | |
| 59-116348 | 7/1984 | Japan . | |
| 59-34221 | 8/1984 | Japan . | |
| 59-52944 | 12/1984 | Japan . | |
| 60-86253 | 5/1985 | Japan . | |
| 60-86255 | 5/1985 | Japan . | |
| 60-245754 | 12/1985 | Japan . | |

*Primary Examiner*—L. Dewayne Rutledge
*Assistant Examiner*—David Schumaker
*Attorney, Agent, or Firm*—Armstrong, Nikaido, Marmelstein, Kubovcik & Murray

[57] ABSTRACT

High strength and high wear resistance copper alloys consisting essentially of (I) 54–66% by weight of Cu, 1.0–5.0% by weight of Al, 1.0–5.0% by weight of Mn, 0.1–2.0% by weight of Si, 0.1–3.0% by weight of Sn, 0.01–1.0% by weight of B, and as the remainder, Zn and inevitable impurities, and (II) 54–66% by weight of Cu, 1.0–5.0% by weight of Al, 1.0–5.0% by weight of Mn, 0.1–2.0% by weight of Si, 0.1–3.0% by weight of Sn, 0.01–1.0% by weight of B, 0.1–4.0% by weight of one or more elements selected from Fe, Ni and Cr, and as the remainder, Zn and inevitable impurities.

2 Claims, No Drawings

HIGH STRENGTH AND WEAR RESISTANCE COPPER ALLOYS

BACKGROUND OF THE INVENTION

The invention relates to copper alloys, and more particularly, to copper alloys having high strength and wear resistance which are suitable for use under high speed and heavy load.

Conventionally, Mn-Si intermetallic compound precipitated brass has been known as a wear resistant copper alloy for use under high speed and heavy load and is a high strength brass containing silicon. There have also been known copper alloys having various elements added thereto in order to improve strength and wear resistance. However, the intermetallic compound $Mn_5Si_3$ in high strength and wear resistance brass is generally a coarse precipitate in either needle or rod form. Also, the compound is oriented in a uniform direction due to plastic deformation. Thus wear resistance of the brass depends upon the direction of orientation. Furthermore, mechanical properties, such as strength and wear resistance, which are required properties of the high strength and wear resistance copper alloys, are not uniform throughout the material, because of coarseness of the matrix structure. Therefore, a conventional Mn-Si precipitated type brass having high strength and wear resistance is not suitable as a material which is to be used under severe frictional conditions, or for precision components requiring reliable quality, in spite of their superior strength and wear resistance as compared to normal high strength brass.

Accordingly, it is an object of the present invention to overcome the disadvantages of the conventional Mn-Si precipitated type brass having high strength and wear resistance.

It is another object of the present invention to provide high strength and wear resistant copper alloys which are suitable for use under high speed and heavy load.

SUMMARY OF THE INVENTION

Copper alloys of the present invention can be obtained in the following way:

(1) forming a matrix of a single $\beta$ phase or $\alpha+\beta$ phase, (2) precipitating an Mn-Si intermetallic compound having improved wear resistance, by adding Mn and Si in a suitable ratio thereto, (3) forming the Mn-Si precipitate into fine grains, by adding Sn and B to the alloy, thereby improving the strength and wear resistance thereof, and (4) decreasing orientation of the precipitate by fining the precipitate, and at same time, fining the grain of the matrix, and thereby providing uniform mechanical properties, such as strength, toughness and wear resistance, which are required for copper alloys having high strength and wear resistance.

Futhermore, according to the present invention complex compounds are formed with the Mn-Si intermetallic compound, by adding one or more elements selected from Fe, Ni and Cr to the alloy. The complex compounds increase the self-strength of the precipitate, and further improve the wear resistance and strength of the copper alloy having high strength and wear resistance.

In the present invention, the composition of the representative basic alloys are: firstly, Cu 54–66%, Al 1.0–5.0%, Mn 1.0–5.0%, Si 0.1–2.0%, Sn 0.1–3.0%,

B 0.01–1.0%, the remainder being Zn and inevitable impurities; and second,

Cu 54–66%,

Al 1.0–5.0%,

Mn 1.0–5.0%,

Si 0.1–2.0%,

Sn 0.1–3.0%,

B 0.01–1.0%, one or more elements selected from Fe, Ni and Cr 0.1–4.0%, the remainder being Zn and inevitable impurities.

All of the percentages used hereinafter are percent by weight.

The content of each element is determined according to the following conditions.

The first alloy according to the present invention has a tensile strength of 55–85 Kgf/mm$^2$, an elongation of 10–20% and a rockwell hardness of 70–100 $H_rB$. The second alloy according to the present invention has a tensile strength of 60–90 Kgf/mm$^2$, an elongation of 10–20% and a rockwell hardness of 80–110 $H_rB$.

Cu : 54–66%

The copper content is that which provides a matrix construction of a $\beta$ single phase or $\alpha+\beta$ phase, together with Al and Zn.

Al : 1.0–5.0%

Al expedites formation of the $\beta$ phase and improves mechanical properties, especially strength and hardness. However, when the content of Al is greater than 5%, it tends to make the grain size too large and easily forms an oxidized slag, and thereby decreases the castability of the alloy. Also, it impairs the toughness of the alloy because an increase of the formation of the phase.

On the other hand, when the content of Al is less than 1%, the effect in improving strength is neglible.

Mn : 1.0–5.0%

Mn improves the mechanical properties together with the Al. Especially, Mn is an indispensable element in forming Mn-Si intermetallic compound precipitates and in improving wear resistance.

However, when the content thereof is greater than 5%, the effect thereof is not remarkable and castability is decreased. On the other hand, when the content thereof is less than 1.0%, formation of the Mn-Si intermetallic compound decreases remarkably.

Si : 0.1–2.0%

Si is an indispensable element for forming an intermetallic compound with Mn. When the content thereof is greater than 2.0%, the alloy is brittle, and thereby toughness is decreased. On the other hand, when the content thereof is less than 0.1%, the precipitation of the intermetallic compound decreases remarkably.

The effect of the addition of each of the elements Sn, B, Fe, Ni and Cr added to the copper alloy of the present invention, is described below.

Sn : 0.1–3.0%

Sn fines the Mn-Si precipitate, i.e., increases the fineness of the precipitate, and thereby improves the strength and toughness of the alloy. Especially, the wear resistance improving effect thereof is superior.

However, when the content thereof is greater than 3.0%, the alloy is brittle. On the other hand, when the content thereof is less than 0.1%, the abovementioned effect can not be recognized.

B : 0.01–1.0%

B has the effect of fining the Mn-Si precipitate, together with the Sn. Additionally, it improves strength and toughness of the alloy even with a small addition thereof, fining the grain of the matrix remarkably. The effect of grain, fining by B is the suppression of growth of grain especially at high temperature, thereby maintaining a fine grain. Thus, the obtained copper alloy does not show a decrease in strength and wear resistance, even with the frictional heat generated under severe frictional conditions, and stabilizes the mechanical properties of the alloy.

However, even if the content thereof is greater than 1.0%, the abovementioned effect does not increase significantly. Therefore, the limitation of 1.0% is preferable from the standpoint of cost. Accordingly, when Sn and B are added to the conventional alloys, strength, toughness, and wear resistance thereof are improved. At the same time, the Mn-Si precipitate is made fine and orientation of the precipitate caused by plastic deformation is decreased.

Also, the grain of the matrix can be made fine. Thus, the mechanical properties of the whole material can be made uniform.

On the other hand, Fe, Ni and Cr combine with the Mn-Si intermetallic compound, thereby forming Mn-Si (Fe, Ni, Cr) complex compounds, when they are added alone or in combination.

The hardness of the obtained complex compound is higher than the Mn-Si intermetallic compound of the conventional alloys, and therefore the effect of improvements of the strength and wear resistance of the alloy is great.

However, when the content of Fe, Ni and Cr is less than 0.1%, effects of the addition are insignificant.

DETAILED DESCRIPTION OF PREFERRED EMBODIMENTS

The invention will be more clearly understood with reference to the following examples.

EXAMPLES

Using a high frequency induction furnace, alloy Nos. 1 through 14 of the present invention and conventional alloys Nos. 1 through 4, having the compositions shown in Table 1 were melted in a graphite crucible under the atmosphere, and cast into a slab having a thickness of 30 mm in an iron mold. After scalping the cast slab, the slab was hot rolled, and made into a plate having a thickness of 10 mm. The hot rolled plate was then annealed at a temperature of about 400° C. for about 5 hours. Test pieces for measuring toughness and wear resistance were collected therefrom, and the tests were carried out. The measurement of wear resistance was carried out according to a Rotate Sliding Abrasion Testing Method, under the following conditions. Namely, a test piece having a doughnut-shape with an inner diameter of 16 $\phi$ was prepared from the 10 mm thick plate. Then, the test piece was positioned to contact an opposite piece made of SUJ-2 steel having a doughnut-shape with an inner diameter of 16 $\phi$ and an outer diameter of 35 . Maximum compressive stress therebetween was 50 Kg/mm$^2$, and the rotational speeds of the test piece and of the opposite piece were 800 rpm and 560 rpm, respectively (sliding ratio, 30%). Abraded quantity (mg) after 500,000 times and 1,000,000 times of sliding were measured respectively. The results thereof are shown in Table 2.

As is apparent from Table 2, ultimate tensile strength (U.T.S.) and toughness of the high strength and wear resistant brass Nos. 1 through 14 of the present invention were improved, compared with that of the conventional alloys, and especially wear resistance thereof was remarkably improved.

Also, it can be noted that grain size of the matrix and Mn-Si intermetallic compound (or complex compound) was diminished considerably, and thereby the mechanical properties required of high strength and high wear resistance copper alloys, such as strength, toughness and wear resistance, were made uniform over the whole of the material.

Namely, alloy No. 4 of the present invention was an alloy where 2.52% of Sn and 0.011% of B were added to a conventional high strength and wear resistant brass. Thus, strength and toughness thereof was improved, and especially improvement of wear resistance and the effect of fining of the MnSi precipitate thereof was remarkable.

Alloy No. 5 of the present invention was an alloy where 0.15% of Sn and 0.664% of B were added to the conventional alloy. Thus, strength and wear resistance thereof were improved, and especially the effects of precipitate fining and grain fining were remarkable. Alloy No. 6 which was an alloy where 1.58% of Sn and 0.121% of B were added to the conventional alloy showed remarkable improvement in strength, toughness and wear resistance. Also, it had a superior grain fining effect. And, if it is considered that the test piece of alloy No. 6 was annealed at a temperature of 400° C. for 5 hours, it is thought that grain growth in alloy No. 6 was suppressed even at a high temperature because of the addition of Sn and B thereto. Accordingly, copper alloys of the present invention did not show a decrease of strength and wear resistance against frictional heat generated under severe frictional conditions. Thus, mechanical properties, such as strength and wear resistance, were stabilized.

These are effects of the fining of the Mn-Si precipitate and the dispersing of it into the matrix uniformly by the addition of Sn and B, and of fining the grain of the matrix.

On the other hand, alloy Nos. 7 through 14 which were alloys where Fe, Ni and Cr were added to alloy No. 3 of the present invention, showed considerable improvement in strength and wear resistance as compared with alloy Nos. 3 and 6. The increase is caused by the formation of Mn-Si (Fe, Ni, Cr) complex compounds which are different from the Mn-Si intermetallic compound in the conventional high strength and wear resistance brass, and remarkably increase the self-hardness of the precipitate.

As is seen from the above description, copper alloys of the present invention having high strength and wear resistance are obtained by fining hardened Mn-Si intermetallic compounds and uniformly dispersing them in the matrix. And at the same time, the generation of orientation of the precipitate caused by plastic deformation is decreased through the fining of the precipitate.

Also, the quality of the alloy is stabilized by maintaining uniform properties over the whole material by fining the grain of the matrix. Therefore, the alloys of the present invention are quite suitable for use as wear resistance precision components requiring reliable quality or for use under severe working conditions.

TABLE 1

| | Cu | AL | Mn | Si | Sn | B | Zn | Fe | Ni | Cr | Co | Zr | V | Pb | Ti |
|---|---|---|---|---|---|---|---|---|---|---|---|---|---|---|---|
| Conventional Alloys | | | | | | | | | | | | | | | |
| 1 | $62^{52}$ | $3^{01}$ | $2^{98}$ | $1^{02}$ | — | — | Rem | — | — | — | — | — | — | — | — |
| 2 | $62^{50}$ | $3^{01}$ | $3^{02}$ | $0^{90}$ | — | — | Rem | — | $0^{31}$ | $0^{13}$ | — | — | — | $0^{57}$ | — |
| 3 | $62^{56}$ | $3^{02}$ | $3^{05}$ | $1^{04}$ | $0^{90}$ | — | Rem | $0^{90}$ | $2^{03}$ | — | — | — | — | — | |
| 4 | $54^{43}$ | $4^{99}$ | $3^{04}$ | $0^{89}$ | — | — | Rem | $2^{01}$ | $1^{03}$ | $0^{30}$ | $0^{36}$ | $0^{31}$ | $0^{34}$ | $0^{60}$ | $0^{96}$ |
| Alloys of the present invention | | | | | | | | | | | | | | | |
| 1 | $55^{47}$ | $1^{52}$ | $4^{55}$ | $1^{51}$ | $0^{72}$ | $0^{053}$ | Rem | — | — | — | — | — | — | — | — |
| 2 | $65^{2}$ | $4^{49}$ | $1^{52}$ | $0^{50}$ | $0^{71}$ | $0^{044}$ | Rem | — | — | — | — | — | — | — | — |
| 3 | $62^{55}$ | $3^{02}$ | $2^{97}$ | $0^{97}$ | $0^{75}$ | $0^{042}$ | Rem | — | — | — | — | — | — | — | — |
| 4 | $62^{72}$ | $2^{96}$ | $2^{94}$ | $1^{01}$ | $2^{52}$ | $0^{011}$ | Rem | — | — | — | — | — | — | — | — |
| 5 | $62^{45}$ | $3^{04}$ | $3^{01}$ | $0^{99}$ | $0^{15}$ | $0^{664}$ | Rem | — | — | — | — | — | — | — | — |
| 6 | $62^{68}$ | $3^{03}$ | $3^{04}$ | $1^{05}$ | $1^{58}$ | $0^{121}$ | Rem | — | — | — | — | — | — | — | — |
| 7 | $62^{61}$ | $3^{00}$ | $2^{95}$ | $1^{02}$ | $0^{69}$ | $0^{042}$ | Rem | $0^{8}$ | — | — | — | — | — | — | — |
| 8 | $62^{54}$ | $3^{01}$ | $2^{78}$ | $0^{98}$ | $0^{72}$ | $0^{045}$ | Rem | $0^{5}$ | $0^{4}$ | $0^{2}$ | — | — | — | — | — |
| 9 | $62^{55}$ | $2^{99}$ | $3^{03}$ | $0^{98}$ | $0^{72}$ | $0^{044}$ | Rem | — | $0^{4}$ | $0^{5}$ | — | — | — | — | — |
| 10 | $62^{62}$ | $3^{04}$ | $2^{99}$ | $1^{01}$ | $0^{75}$ | $0^{040}$ | Rem | $0^{5}$ | — | $0^{5}$ | — | — | — | — | — |
| 11 | $62^{54}$ | $3^{01}$ | $3^{01}$ | $1^{04}$ | $0^{71}$ | $0^{042}$ | Rem | — | $2^{3}$ | — | — | — | — | — | — |
| 12 | $62^{45}$ | $3^{04}$ | $2^{98}$ | $1^{10}$ | $0^{72}$ | $0^{042}$ | Rem | — | — | $0^{8}$ | — | — | — | — | — |
| 13 | $62^{58}$ | $3^{10}$ | $2^{95}$ | $0^{98}$ | $0^{75}$ | $0^{043}$ | Rem | $1^{0}$ | $1^{5}$ | $0^{4}$ | — | — | — | — | — |
| 14 | $62^{55}$ | $2^{99}$ | $3^{02}$ | $1^{01}$ | $1^{58}$ | $0^{121}$ | Rem | $1^{0}$ | $1^{4}$ | $0^{6}$ | — | — | — | — | — |

TABLE 2

| | Mechanical Properties | | | Abraded quantity | | | Size of | |
|---|---|---|---|---|---|---|---|---|
| | U.T.S. | El | | No. of slidings(times) | | G/S | precipitate (μm) | |
| | (Kgf/mm²) | (%) | $H_R$ B | 500,000 | 1,000,000 | (m/m) | Diameter | Length |
| Conventional Alloys | | | | | | | | |
| 1 | $68^{02}$ | $12^{4}$ | 87 | $31^{9}$ | $58^{0}$ | $0^{80}$ | 10 | 20 |
| 2 | $65^{21}$ | $12^{2}$ | $85^{5}$ | $26^{5}$ | $40^{2}$ | $0^{50}$ | 10 | 20 |
| 3 | $67^{17}$ | $10^{2}$ | 87 | $28^{8}$ | $45^{4}$ | $0^{55}$ | 10 | 20 |
| 4 | $70^{32}$ | $12^{5}$ | 88 | $26^{7}$ | $42^{3}$ | $0^{60}$ | 10 | 17 |
| Alloys of the present invention | | | | | | | | |
| 1 | $74^{42}$ | $16^{4}$ | 90 | $18^{6}$ | $23^{4}$ | $0^{07}$ | 3 | 6 |
| 2 | $75^{17}$ | $14^{6}$ | $90^{5}$ | $27^{7}$ | $37^{2}$ | $0^{15}$ | 3 | $5^{5}$ |
| 3 | $75^{32}$ | $14^{8}$ | $90^{5}$ | $18^{8}$ | $23^{1}$ | $0^{07}$ | 3 | 6 |
| 4 | $74^{37}$ | $13^{4}$ | $89^{5}$ | $20^{4}$ | $25^{6}$ | $0^{55}$ | 4 | 9 |
| 5 | $70^{98}$ | $16^{2}$ | 88 | $25^{7}$ | $34^{4}$ | $0^{07}$ | 4 | 9 |
| 6 | $78^{45}$ | $13^{4}$ | 92 | $17^{5}$ | $22^{8}$ | $0^{040}$ | $2^{5}$ | 6 |
| 7 | $80^{65}$ | $14^{2}$ | 93 | $16^{2}$ | $20^{5}$ | $0^{055}$ | 3 | 4 |
| 8 | $82^{74}$ | $12^{8}$ | $94^{5}$ | $15^{3}$ | $18^{9}$ | $0^{040}$ | $2^{5}$ | $3^{5}$ |
| 9 | $79^{78}$ | $14^{4}$ | 92 | $15^{9}$ | $20^{4}$ | $0^{055}$ | 3 | 4 |
| 10 | $80^{21}$ | $14^{8}$ | $93^{5}$ | $15^{4}$ | $18^{6}$ | $0^{050}$ | 3 | 4 |
| 11 | $80^{89}$ | $16^{2}$ | $93^{5}$ | $16^{0}$ | $20^{5}$ | $0^{050}$ | 3 | 4 |
| 12 | $80^{21}$ | $15^{4}$ | 93 | $16^{1}$ | $20^{4}$ | $0^{060}$ | 3 | 4 |
| 13 | $85^{34}$ | $15^{2}$ | 95 | $12^{1}$ | $17^{1}$ | $0^{045}$ | $2^{5}$ | 3 |
| 14 | $87^{25}$ | $15^{6}$ | 97 | $11^{5}$ | $15^{4}$ | $0^{045}$ | 2 | $2^{4}$ |

What is claimed is:

1. A high strength and high wear resistance copper alloy, consisting essentially of:

54–66% by weight Cu,
1.0–5.0% by weight Al,
1.0–5.0% by weight Mn,
0.1–2.0% by weight Si,
0.1–3.0% by weight Sn,
0.01–1.0% by weight B,
and the remainder being Zn and inevitable impurities,
wherein the said alloy has a tensile strength of 55–85 Kgf/mm²,
an elongation of 10–20%,
and a rockwell hardness of 70–100 $H_rB$.

2. A high strength and high wear resistance copper alloy, consisting essentially of:

54–66% by weight Cu,
1.0–5.0% by weight Al,
1.0–5.0% by weight Mn,
0.1–2.0% by weight Si,
0.1–3.0% by weight Sn,
0.01–1.0% by weight B,
0.1–4.0% by weight of one or more elements selected from the group consisting of Fe, Ni and Cr,
the remainder being Zn and inevitable impurities,
wherein the said alloy has a tensile strength of 60–90 Kgf/mm²,
an elongation of 10–20%,
and a rockwell hardness of 80–110 $H_rB$.

* * * * *